US005792974A

United States Patent [19]

Daqis et al.

[11] Patent Number: 5,792,974

[45] Date of Patent: Aug. 11, 1998

[54] ADD-ON ARMOR

[75] Inventors: Joshua Daqis, Acco; Yehiel Reifen; David Eilon, both of Kiryat Hayim; Dan Yaziv, Haifa; Avi Danon, Adi; Uzi Appel, Kiryat Bialik, all of Israel

[73] Assignee: The State of Israel, Ministry of Defence Armament Development Authority Rafael, Haifa, Israel

[21] Appl. No.: 617,085

[22] Filed: Mar. 18, 1996

[30] Foreign Application Priority Data

Mar. 20, 1995 [IL] Israel ..... 113041

[51] Int. Cl.[6] ..... F41H 5/013

[52] U.S. Cl. ..... 89/36.02; 89/36.08; 109/49.5

[58] Field of Search ..... 89/36.01, 36.02, 89/36.04, 36.05, 36.06, 36.07, 36.08; 109/49.5, 78, 79, 81

[56] References Cited

U.S. PATENT DOCUMENTS

| | | | |
|---|---|---|---|
| 2,283,484 | 5/1942 | Bak | 89/36.02 |
| 4,167,889 | 9/1979 | Bohne et al. | 89/36.02 |
| 4,412,495 | 11/1983 | Sankar | 109/49.5 |
| 4,713,275 | 12/1987 | Riccitiello et al. | 428/76 |
| 4,928,575 | 5/1990 | Smirlock et al. | 89/36.02 |
| 5,083,515 | 1/1992 | Seksaria et al. | 109/49.5 |
| 5,170,690 | 12/1992 | Smirlock et al. | 89/36.08 |
| 5,191,166 | 3/1993 | Smirlock et al. | 109/49.5 |
| 5,306,532 | 4/1994 | Tsien et al. | 89/36.02 |
| 5,333,532 | 8/1994 | Smirlock et al. | 89/36.02 |

FOREIGN PATENT DOCUMENTS

| | | | |
|---|---|---|---|
| OS 30 23 951 | 1/1982 | Germany . | |
| OS 31 39 911 | 3/1982 | Germany . | |
| OS 35 22 378 | 1/1987 | Germany . | |
| OS 35 06 128 | 5/1987 | Germany . | |
| OS 35 44 217 | 6/1987 | Germany . | |
| 40 38 159 | 6/1992 | Germany . | |
| 322582 | 3/1936 | Italy | 89/36.02 |
| 9200497 | 1/1992 | WIPO | 89/36.05 |

OTHER PUBLICATIONS

Handbook of Fastening and Joining of Metal Parts, by Vallory H. Laughner et al. 1956, p. 466.

*Primary Examiner*—Stephen M. Johnson

*Attorney, Agent, or Firm*—Gary M. Nath; Nath & Associates

[57] ABSTRACT

An add-on armor system for releasable attachment to an external surface of a hull of a vehicle comprising a plurality of juxtaposed armor tiles. Each armor tile is releasably attached to the hull of the vehicle by means of a fastening assembly and has an attachment surface matching the hull portion to which it is attached. The fastening assembly is a snap-type assembly which has a first engagement member in form of a profiled shank and a second engagement member comprising a profiled socket serving as releasable catch for snappingly engaging the profiled shank. The fastening assembly further comprises a shock absorbing plate secured to the hull.

13 Claims, 1 Drawing Sheet

ADD-ON ARMOR

FIELD OF THE INVENTION

The invention relates to an add-on armor comprising a plurality of armor tile elements to be attached to armored vehicles and the like, thereby constituting a supplementary layer of armor thereon.

BACKGROUND OF THE INVENTION

Add-on armor of the kind specified, also referred to as survivability enhancement systems are disclosed, for example, in U.S. Pat. No. 4,928,575; U.S. Pat. No. 5,191,166; U.S. Pat. No. 5,170,690 and U.S. Pat. No. 5,333,532. Each of these systems comprises an array of armor tile elements releasably attached to the hull of an armored vehicle in mutually mating juxtaposition. In these systems each tile element has an attachment surface corresponding to an external surface of the vehicle, which is adapted to be releasably attached thereto by means of two interengagable and separable fastener structures of which one is secured to the attachment surface of the tile element and the other to an external surface of the vehicle.

In these known systems the fastener structures have base layers formed with fastening elements, a first fastener structure having a plurality of loops and a second one having a plurality of hooking elements. The base layer of the first structure is secured to the attachment surfaces of the armor tile element and the base layer of the second structure to the external surface of the vehicle. By virtue of interengagement of the hooks and loops, the armor tile elements are installed on the external surface of the vehicle so as to be maintained in the attached position, even when the system is subjected to large shear forces such as upon ballistic impact or shattering of an adjacent tile element, thus constituting a composite supplementary armor layer on the surface of the vehicle.

However, the hooks-and-loops manner of attachment of the tile elements to a hull of a vehicle is rather time consuming, especially in view of the large number of tile elements. Moreover, in these systems any impact on the tiles is transmitted directly to the underlying hull without any intermittent shock absorption which is an obvious disadvantage.

It is the object of the present invention to provide an improved survivability enhancement system for use in an armored vehicle.

SUMMARY OF THE INVENTION

In accordance with the present invention there is provided an add-on armor system for releasable attachment to an external surface of a hull of a vehicle, comprising a plurality of juxtaposed armor tiles each releasably attached to the hull of the vehicle by means of a fastening assembly and having an attachment surface matching the hull portion to which it is attached, the fastening assembly having first and second engagement members, characterized in that said fastening assembly is a snap-type assembly in which said first engagement member is in form of a profiled shank and said second engagement member comprises a profiled socket serving as releasable catch for snappingly engaging said profiled shank; and in that the fastening assembly comprises a shock absorbing plate secured to the hull.

The armor tiles may be made of any suitable armor material such as ceramics, various composites, high hardness steel and the like.

The shock absorbing plate may be an elastic plate, e.g. a plate of rubber or an artificial elastomer, or be a suitable composite. If desired, the plate may be covered by a protective metal sheet. The shock absorbing plate may consist of separate segments, each preferably co-extensive with an associated tile, or rather be in the form of a continuous layer.

In accordance with one embodiment of the invention, said first engagement member is secured to the attachment surface of a tile and the said second engagement member is integral with said shock absorbing plate. In accordance with this embodiment the said profiled socket is located within a boss of the elastic plate, whereby the preponderant portions of each tile and the associated elastic plate are kept apart.

In accordance with another embodiment of the invention, said first engagement member is integral with said shock absorbing plate and said second engagement member is secured to the attachment surface of an armor tile.

Due to the snap-type fastening assembly the add-on armor system according to the invention can be readily mounted on the hull, and also readily and quickly be dismantled when required, e.g. for replacement when damaged. At the same time the attachment of the add-on armor tiles is sufficiently strong for ensuring that upon impact of a projectile on a tile or shattering of a neighboring tile, the stresses are dissipated by transmission to the shock absorbing plate which ensures that all tiles remain in place without falling off.

The profiled shank of said first engagement member may have any suitable shape, e.g. have a head portion in form of a truncated cone tapering in the direction away from the tile or be ball-shaped and the like, and the socket of said second engagement member will be so profiled as to be capable of releasably catching the shank by snappingly engaging said head portion.

The invention further provides for use in an add-on armor system of the kind defined herein, an armor tile having an attachment surface with an engagement member secured thereto.

The invention further provides for use in an add-on armor system of the kind defined herein, an elastic plate having a first face for attachment to the hull of a vehicle and a second face with at least one integral engagement member. When the elastic plate is integral with a second engagement member it is preferred that the said profiled socket is located within a boss protruding from said second face.

The invention further provides for an armored vehicle fitted with an added-on armor system of the kind defined herein.

BRIEF DESCRIPTION OF THE DRAWING

For better understanding of the present invention and to show how the same may be carried out in practice it will now be described, by way of example only, with reference to FIG. 1 which is a schematic fragmentary cross-sectional view of one embodiment of an add-on armor system according to the present invention.

DETAILED DESCRIPTION OF THE PREFERRED EMBODIMENT

Figure 1:
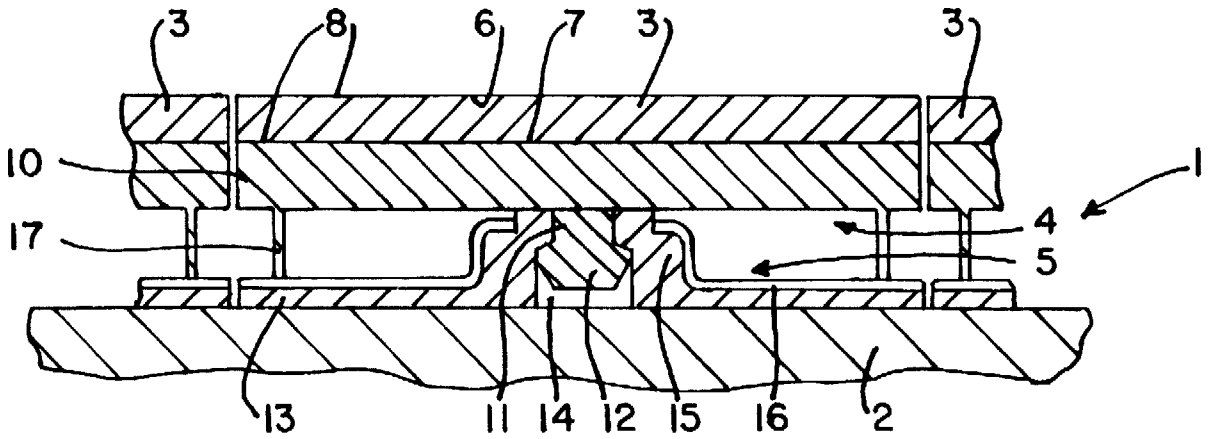

In the embodiment of the add-on armor system according to the present invention shown in FIG. 1, the first engagement member is secured to the attachment surface of the tile and the second engagement member is integral with the shock absorbing plate. As shown, the system, generally designated as 1 is attached to an external surface 2 of a hull of a vehicle (not shown). The system 1 comprises an array of armor tiles 3 each attached to the hull of the vehicle by means of a fastening assembly consisting of a first engagement member generally designated as 4, secured to the tile 3, and a second engagement member generally designated as 5, secured to the external surface 2 and releasably interengaging with the first member 4.

The armor tiles 3 are preferably of a polygonal, e.g. square shape and are made of a suitable armor material, e.g. ceramics. Each tile 3 has two opposed surfaces 6 and 7 and preferably at least the upper surface 6 is covered with a plate 8 of a high tensile strength material such as, for example, Kevlar. The lower surface 7 of the tile 3 constitutes an attachment surface which bears the first engagement member 4.

As shown, the first member 4 comprises a base layer 10 which is secured to the lower surface 7 of tile 3 and is formed integrally with a profiled shank 11 having a head 12 which in the embodiment here illustrated is in form of a truncated cone tapering in the direction away from the tile 3. Obviously, head 12 may have any other suitable shape, e.g. be ball-shaped.

The second engagement member 5 comprises a shock absorbing elastic plate 13 which is secured to the external surface 2 of the hull. The elastic plate 13 shown in FIG. 1 is in the form of separate segments each being co-extensive with an associated armor tile 3. Alternatively, plate 13 may also be in the form of a continuous layer. The elastic plate 13 has a first face 13' for attachment to the hull of a vehicle and a second face 13", and comprises a profiled socket 14 located in a boss 14' protruding from the second face 13" and having such a shape as to snappingly engage the profiled shank 11. Thus, for example, the socket 14 may be formed with an internal shoulder 15. The elastic plate 13 may be made of plastics, elastomer or rubber, or it may rather be in the form of a shock absorbing composite structure. Preferably, the elastic plate 13 is covered with a protective metal sheet 16 having an opening 16' for the socket 14. The first engagement member 4 is formed, in this case, with stems 17 adapted to thrust against the metal sheet 16 for supporting the latter and maintaining it in the position. The base layer 10 and the elastic plate 13 are secured to the respective surfaces 7 and 2 by either adhesive bonding or glue or by suitable mechanical means.

From the foregoing it is readily understood that by a simple insertion of the profiled shank 11 into the socket 14, the armor tile 3 is snappingly engagement to the hull and the snapping fastening ensures that the area of contact between the members is, on the one hand, comparatively small while on the other hand, being sufficient for an effective dissipation of energy resulting from a ballistic impact on a tile to the elastic plate 13 and for efficient absorption thereby.

The snapping engagement of tile 3 with the hull also provides for quick and easy dismantling whenever required.

When a hard projectile, e.g. of the armor piercing type, impacts one of the armor tiles, a high impedance of the tile material causes the development of a high amplitude shock wave on the projectile, breaking the latter up into several pieces. When an eroding projectile, such as a penetration fragment-simulating projectile, penetrates an armor tile, the high resistance thereof causes a strong erosion of the projectile. The base layer 10 supports the tiles during a ballistic impact and captures fragments of broken tiles, thus attenuating the residual kinetic energy. Thus, the initial kinetic energy of the projectile is carried off by the exploded or eroded projectile material and by a deformation of plate 10, while most of the residual energy is absorbed by the shock absorbing plate 13.

We claim:

1. An add-on armor system for releasable attachment to an external surface of a hull of a vehicle, comprising: a plurality of shock absorbing plates secured to the hull; and a plurality of juxtaposed armor tiles each releasably attached to the hull of the vehicle by means of a fastening assembly and said armor tile having an attachment surface matching a portion of said hull to which said attachment surface is attached, the fastening assembly having first and second engagement members, characterized in that said fastening assembly is a snap-type assembly in which said first and second engagement members are integral with said shock absorbing plate and armor tile and said first engagement member is in form of a profiled shank and said second engagement member is in form of a profiled socket serving as releasable catch for snappingly engaging said profiled shank, and in that said shock absorbing plates are made of an elastic material being a member selected from the group of rubber and artificial elastomers.

2. An add-on armor system according to claim 1, wherein said shock absorbing plate is an elastic plate.

3. An add-on armor system according to claim 1, wherein said shock absorbing plate is covered by a protective metal sheet.

4. An add-on armor system according to claim 1, wherein said first engagement member is secured to the attachment surface of a tile and the said second engagement member is integral with said shock absorbing plate.

5. An add-on armor system according to claim 4, wherein said profiled socket is located within a portion of the shock absorbing plate that protrudes therefrom away from the hull.

6. An add-on armor assembly according to claim 1, wherein said first engagement member is integral with a base plate secured to said attachment surface and said shock absorbing plate having an integral said second engagement member, said shock absorbing plate being attached to an external surface of the hull.

7. An add-on armor system according to claim 1, wherein said shock absorbing plate is in the form of separate segments co-extensive with associated tiles.

8. An add-on armor system according to claim 1, wherein said shock absorbing plate is in the form of a continuous layer.

9. An add-on armor system according to claim 1, said attachment surface bearing one of said first or second engagement members.

10. An armored vehicle fitted with an added-on armor system according to claim 1.

11. An add-on armor system for releasable attachment to an external surface of a hull of a vehicle, comprising: a plurality of shock absorbing plates secured to the hull; and a plurality of juxtaposed armor tiles each releasably attached to the hull of the vehicle by means of a fastening assembly and said armor tile having an attachment surface matching a portion of said hull to which said attachment surface is attached, the fastening assembly having first and second engagement members, characterized in that said fastening assembly is a snap-type assembly in which said first and second engagement members are integral with said shock absorbing plate and armor tile and said first engagement member is in form of a profiled shank and said second engagement member comprises a profiled socket serving as releasable catch for snappingly engaging said profiled shank, wherein said shock absorbing plate includes an elastic plate having a first face for attachment to the hull of a vehicle and a second face into which opens said profiled socket.

12. An add-on armor system according to claim 11, wherein said second engagement member is located within a boss protruding from said second face.

13. An add-on armor system for releasable attachment to an external surface of a hull of a vehicle, comprising: a plurality of shock absorbing plates secured to the hull; and a plurality of juxtaposed armor tiles each releasably attached to the hull of the vehicle by means of a fastening assembly and said armor tile having an attachment surface matching a portion of said hull to which said attachment surface is attached, the fastening assembly having first and second engagement members, characterized in that said fastening assembly is a snap-type assembly in which said first and second engagement members are integral with said shock absorbing plate and armor tile and said first engagement member is in form of a profiled shank having a head portion in the form of a truncated cone tapering in a direction away from the tile and said second engagement member comprises a profiled socket serving as a releasable catch for snappingly engaging said head portion of the profiled shank.

* * * * *